US007350772B2

(12) United States Patent
Legrand

(10) Patent No.: US 7,350,772 B2
(45) Date of Patent: Apr. 1, 2008

(54) FOLDABLE FOAM-BASED DIVIDER DEVICE

(76) Inventor: Christian Legrand, 100/203 M. Chollada Soi 23/4, Ampur Bangbuathong, 11.110 Nonthaburi (TH)

( * ) Notice: Subject to any disclaimer, the term of this patent is extended or adjusted under 35 U.S.C. 154(b) by 197 days.

(21) Appl. No.: 11/256,740

(22) Filed: Oct. 24, 2005

(65) Prior Publication Data

US 2007/0090335 A1 Apr. 26, 2007

(51) Int. Cl.
*E04H 17/16* (2006.01)

(52) U.S. Cl. ..... 256/25; 256/24; 256/26; 160/135; 160/351; 49/501

(58) Field of Classification Search ..... 256/67, 256/24, 26, 73, 51; 160/135, 229.1, 231.1, 160/232, 351; 428/304.4, 317.1; 5/727, 5/417, 420; 40/124.13, 605; 49/501
See application file for complete search history.

(56) References Cited

U.S. PATENT DOCUMENTS 3,777,321 A * 12/1973 Hargett ..... 5/99.1
4,300,856 A * 11/1981 Magoon et al. ..... 405/66
4,491,166 A * 1/1985 Hanna ..... 160/351
4,630,863 A * 12/1986 Roberts ..... 297/219.1
4,679,848 A * 7/1987 Spierings ..... 297/230.14
5,007,473 A * 4/1991 Evensen ..... 160/135
5,066,001 A * 11/1991 Wilkinson ..... 482/52
D348,988 S * 7/1994 Bro et al. ..... D6/331
5,491,851 A * 2/1996 Alonso ..... 5/722
5,537,766 A * 7/1996 Nickens et al. ..... 40/605
5,538,132 A * 7/1996 Propp et al. ..... 206/365
5,974,713 A * 11/1999 Wu ..... 40/733
6,058,535 A * 5/2000 Firkins et al. ..... 5/653
6,123,321 A * 9/2000 Miller ..... 256/25
6,257,559 B1 * 7/2001 Mouri ..... 256/26
6,293,328 B1 * 9/2001 Fremont ..... 160/135
6,408,594 B1 * 6/2002 Porter ..... 52/794.1
6,676,113 B2 * 1/2004 Christensen et al. ..... 256/25
6,711,766 B2 * 3/2004 Monk et al. ..... 5/420
6,945,518 B1 * 9/2005 Chrysler ..... 256/25
7,036,162 B1 * 5/2006 Gatten ..... 5/421
7,065,814 B2 * 6/2006 Rutkowski ..... 5/655

* cited by examiner

*Primary Examiner*—Robert J. Sandy
*Assistant Examiner*—Nahid Amiri
(74) *Attorney, Agent, or Firm*—Adam H. Jacobs

(57) ABSTRACT

A foldable foam-based divider device includes a plurality of panels, each panel including a middle foam plate and front and back semi-rigid paper plates mounted on and sandwiching the middle foam plate, the middle foam plate further including at least one outwardly extending connecting tab and at least one tab-receiving recess with adjacent ones of the plurality of panels connected to one another in accordion-like fashion with the connecting tab extending into the tab-receiving recess and being secured therein by connection of the front and back semi-rigid paper plates to the connecting tab. The plurality of panels is movable between a closed position with the plurality of panels forming a folded stack of generally parallel panels and an opened position wherein the plurality of panels forms an extended wall operative to selectively divide an area.

5 Claims, 4 Drawing Sheets

FOLDABLE FOAM-BASED DIVIDER DEVICE

BACKGROUND OF THE INVENTION

1. Technical Field

The present invention relates to divider devices for rooms and play areas and, more particularly, to a foldable foam-based divider device including a plurality of panels, each panel including a middle foam plate and front and back semi-rigid paper plates mounted on and sandwiching the middle foam plate, the middle foam plate further including at least one outwardly extending connecting tab formed on one side of the middle foam plate and at least one tab-receiving recess formed on an opposite side of the middle foam plate, with adjacent ones of the plurality of panels connected to one another in accordion-like fashion with the connecting tab extending into the tab-receiving recess and being secured therein by connection of the front and back semi-rigid paper plates to the tab thus securing adjacent panels to one another, the plurality of panels moveable between a closed position with the plurality of panels forming a folded stack of generally parallel panels and an opened position where the plurality of panels forms an extended wall operative to selectively divide a play area.

2. Description of the Prior Art

There are many different kinds of dividing wall devices which are proposed for use in connection with restricting the play areas of children. This include such devices as indoor fencing, cardboard or plastic walls or even elaborate house and castle-like structures which serve not only to enhance the play experience for the child but also serve to restrict the area in which the child can play thereby making monitoring of the child easier. Each of these devices attempt, in their own way, to fulfill the basic task of preventing unauthorized exit of the child from the designated play area, and to some extent these devices do perform this task. However, there are inherent defects and problems with each of these prior art devices which render all of them somewhat ill-designed for their intended use, including the fact that many of the devices have sharp edges, are not entirely flexible as to the area of which can be partitioned and also may be somewhat difficult to place within or move into the play area to complete the partitioning process. There is therefore a need for a divider device which can be quickly and easily placed in and removed from a play area and offers numerous configurations to define the perimeter of the permitted play area through use of the divider device.

As was previously discussed, numerous types of construction materials have been used in connection with play room divider devices, including the aforementioned plastic, metal and other such construction materials. While such construction materials may be necessary for use in connection with divider devices used for children ages three and up, for toddlers and infants who do not have a lot of strength or the ability to reach over the top of a divider device, such sturdy and heavy materials are not necessary. In fact, the use of such heavy materials may pose a safety threat to the toddler or infant as the wall structure, if it were to fall on the infant or toddler, might injure the infant or toddler due to the impact of the heavy material. There is therefore a need for a lightweight yet sturdy divider device for use with an infant or toddler which may be quickly and easily set up around an infant or toddler to safely partition a play area but which will not present a significant threat or danger to the infant or toddler should the divider device accidentally fall onto the infant or toddler.

Therefore, an object of the present invention is to provide a foldable foam-based divider device for partitioning an area.

Another object of the present invention is to provide a foldable foam-based divider device which includes a plurality of panels, each panel including a middle foam plate and front and back semi-rigid paper plates mounted on and sandwiching the middle foam plate, the middle foam plate further including at least one outwardly extending connecting tab on one side of the middle foam plate and at least one tab-receiving recess formed on an opposite side of the middle foam plate.

Another object of the present invention is to provide a foldable foam-based divider device in which adjacent panels are connected to one another in an accordion-like fashion with the connecting tab extending into the tab-receiving recess of the adjacent panel and being secured therein by connection of the front and back semi-rigid paper plates to the connecting tab, thereby securing adjacent panels to one another.

Another object of the present invention is to provide a foldable foam-based divider device in which the plurality of panels are moveable between a closed position where the plurality of panels form a folded stack of generally parallel panels and an opened position where the plurality of panels forms an extended wall operative to selectively divide an area.

Another object of the present invention is to provide a foldable foam-based divider device which includes soft edges to prevent accidental injury to the infant or toddler being retained within the divider device yet has sufficient rigidity to maintain the upright wall position when the plurality of panels forms an extended wall.

Another object of the present invention is to provide a foldable foam-based divider device which will permit the personalization of the divider device as the front and back paper plates may be written upon by any appropriate writing device in order to render the divider device more visually interesting for the infant or toddler being retained within the divider device.

Finally, an object of the present invention is to provide a foldable foam-based divider device which is relatively simple and inexpensive to manufacture and is safe, efficient and effective in use.

SUMMARY OF THE INVENTION

The present invention provides a foldable foam-based divider device including a plurality of panels, each panel including a middle foam plate and front and back semi-rigid paper plates mounted on and sandwiching the middle foam plate, the middle foam plate further including at least one outwardly extending connecting tab on one side of the middle foam plate and at least one tab-receiving recess formed on an opposite side of the middle foam plate. Adjacent ones of the plurality of panels are connected to one another in accordion-like fashion with the at least one connecting tab extending into the at least one tab-receiving recess and being secured therein by connection of the front and back semi-rigid paper plates to the at least one connecting tab thereby securing adjacent ones of the plurality of panels. Finally, the plurality of panels are movable between a closed position with the plurality of panels forming a folded stack of generally parallel panels and an opened position where the plurality of panels forms an extended wall operative to selectively divide an area.

The present invention as thus described provides many features not found in those devices in the prior art. For example, because the foam-based divider device may be quickly and easily folded in accordion-like fashion into the closed position with the plurality of panels forming a folded stack of generally parallel panels, storage of the divider device is much easier than storage of similar devices found in the prior art. Furthermore, because of the construction materials used in connection with the divider device, specifically, the middle foam plate and front and back semi-rigid paper plates, the divider device is extremely light yet provides an effective barrier for infants and toddlers to retain them within a selected area. Furthermore, due to the light weight of the construction materials used with the present invention, even if the divider device of the present invention is accidentally tipped over onto the infant or toddler, it is highly unlikely that injury would result, as opposed to those metal and plastic divider devices presently used in the prior art. Also, it should be noted that one of the important features of the foldable foam-based divider device of the present invention is that the panels each include a middle foam plate and front and back semi-rigid paper plates which add rigidity to the middle foam plate to ensure the ability of the panel to stand upright while not making the panel overly thick or unwieldy as would be necessary if only a foam construction material were used for the foam plates. The use of the front and back semi-rigid paper plates also allows personalization of the divider device, which is virtually impossible to accomplish if the outer plates of the device are constructed from foam. Finally, because the connection between the panels includes an extension of the middle foam plate which is retained within a recess of the adjacent foam plate, the foldable foam-based divider device of the present invention will have an extended useable life span and an improved aesthetic appearance. It is therefore seen that the foldable foam-based divider device of the present invention provides a substantial improvement over those divider devices found in the prior art.

DESCRIPTION OF THE PREFERRED EMBODIMENT

Figure 1:
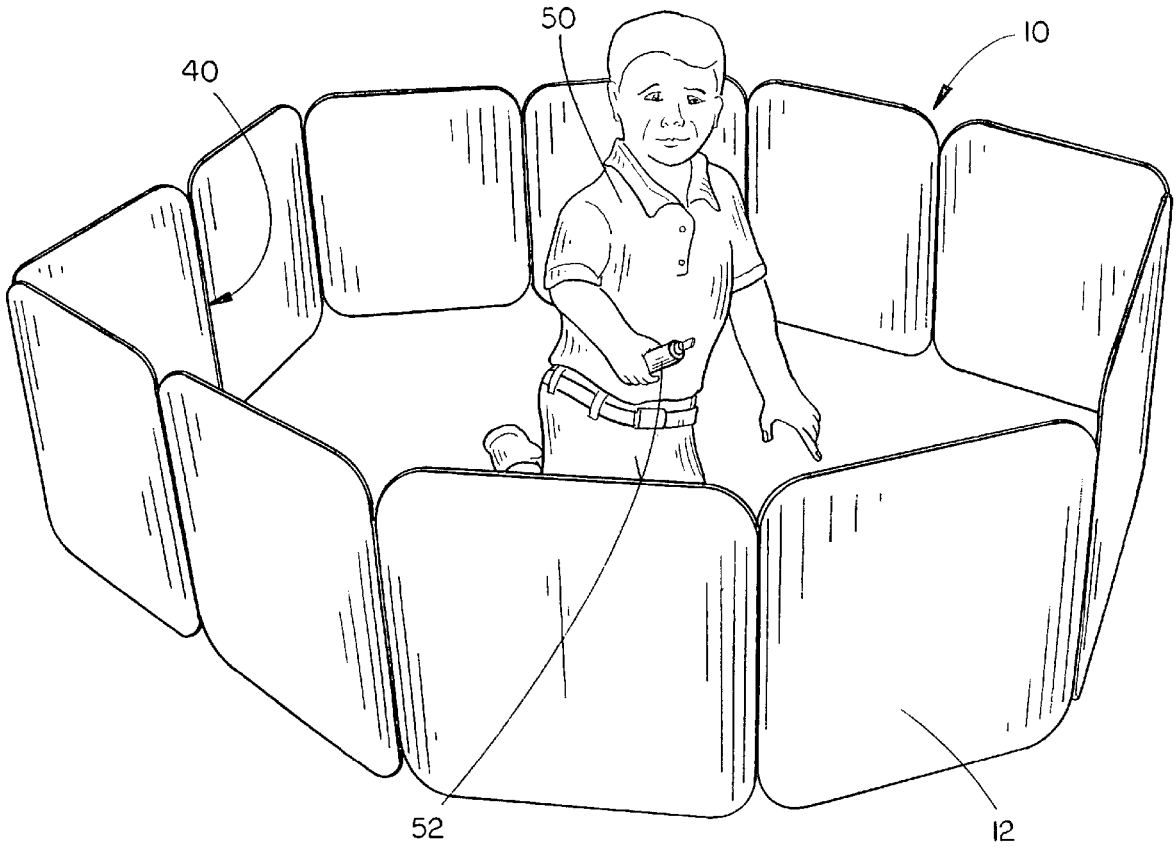
FIG. 1 is a perspective view of a child surrounded by the divider device of the present invention.

The foldable foam-based divider device 10 of the present invention is shown best in FIGS. 1-4 as including a plurality of foam-based wall panels 12, each of which would be constructed in substantially the same manner. Specifically, each of the divider panels 12 would include a middle foam plate 14 and front and back semi-rigid paper plates 16 and 18, the front and back paper plates 16 and 18 secured to the middle foam plate 14 by an adhesive material or the like to ensure that the front and back paper plates 16 and 18 remain attached to the middle foam plate 14. In the preferred embodiment, the middle foam plate 14 would preferably be constructed of a foam material, specifically the foam marketed under the common name "Eva Foam", which is a polymer foam made of ethyl-vinyl acetate and which is non-toxic and resilient to tearing, and thus is quite safe for use with children. However, one of the disadvantages of Eva Foam is that it is pliable and easily bendable, and thus is not well-suited for use as a divider device wall panel. In addition, the foam material does not readily permit writing thereon due to the surface characteristics of the foam material. To render the wall panels 12 more rigid, it is therefore necessary to include the front and back semi-rigid plates 16 and 18 affixed to the middle foam plate 14.

In the preferred embodiment, the front and back paper plates 16 and 18 would be constructed of a semi-rigid paper material such as cardstock or the like which would readily take ink, crayon, pencil or the markings of virtually any type of writing implement thereon, and which would provide the necessary structural rigidity for the middle foam plate 14 to allow the wall plate 12 to serve as a panel for the divider device 10 of the present invention. Furthermore, it is important that the front and back paper plates 16 and 18 have dimensions slightly smaller than the middle foam plate 14 such that the middle foam plate 14 extends beyond the edges of the front and back paper plates 16 and 18, as shown best in FIGS. 2 and 3, thus ensuring that the edges of the wall panels 12 are foam and thus preventing paper cuts or other injuries to children who are being retained in a selected area by use of the present invention. A final important consideration for the wall panels 12 is that they may be constructed of virtually any size, shape and thickness, such as in a die cut pattern which resembles a castle or a forest or any other child-pleasing design, which will add to the whimsical yet useful nature of the foldable foam-based divider device 10, so long as the wall panels 12 may be configured in the opened position shown best in FIGS. 1 and 3.

In fact, it is entirely possible that the wall panels 12 may be constructed as having dimensions smaller than that desirable for use as wall panels 12, and thus the foldable foam-based divider device 10 of the present invention could be used as an accordion-fold book, particularly as a children's book, to permit display of extended images such as panoramas, and further provide a unique setting for individual expression by children owning the book, as they may easily write on any or all of the pages, e.g. wall panels 12, of the smaller-sized foldable foam-based divider device 10 when it is used as a book. Of course, as was described previously, the size and shape of the wall panels 12 may be modified and thus the intended use of the foldable foam-based divider device 10 of the present invention is not critical to the present invention. It is therefore noted that the inventive child will likely think of many other uses for the present invention other than those described herein.

Figure 4:
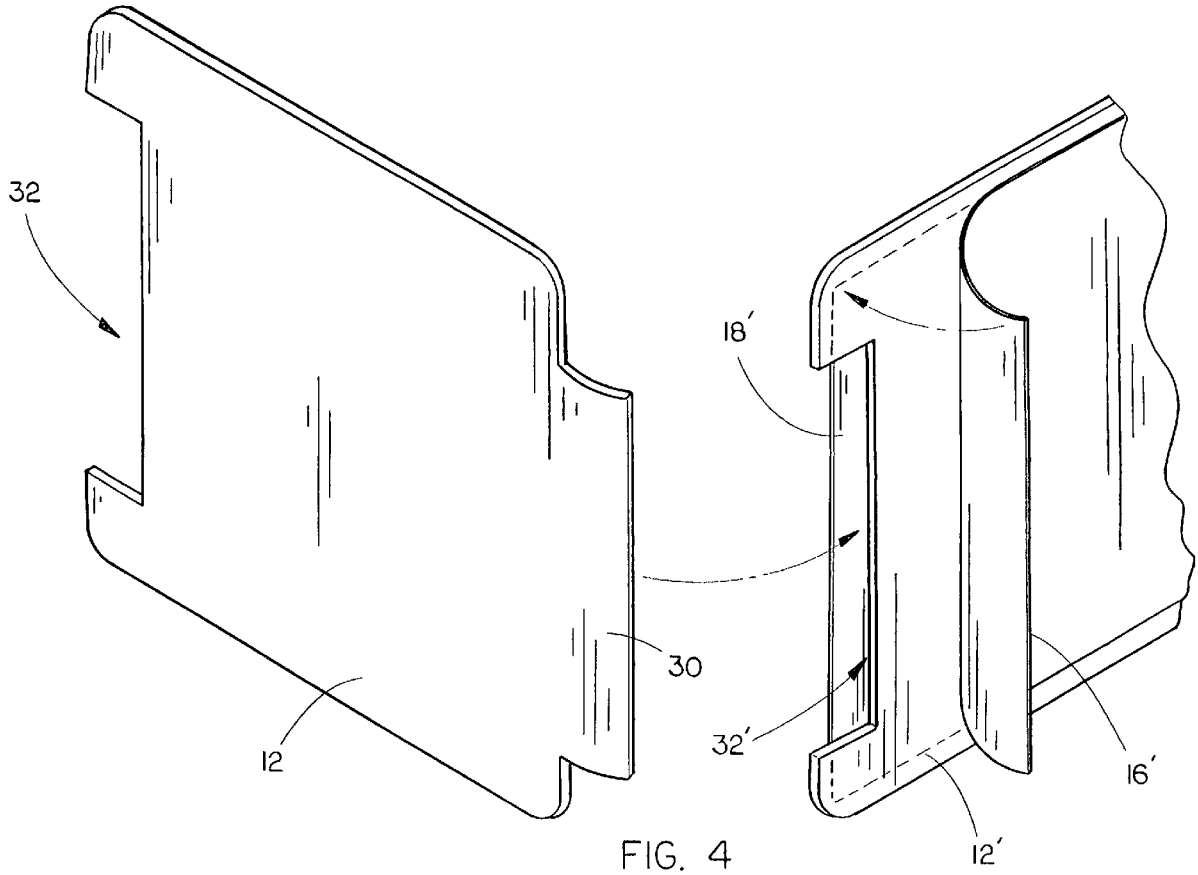
FIG. 4 is a detailed perspective view of adjacent panels of the present invention showing how the panels are connected to one another.

To secure the wall panels 12 to one another, each of the middle foam plates 14 would preferably include an outwardly extending connecting tab 30 and an inwardly extending tab-receiving recess 32 formed on the opposite side of the middle foam plate 14, as shown best in FIG. 4. To secure adjacent wall panels 12 to one another, the first wall panel 12 would be positioned adjacent the second wall panel 12' and the connecting tab 30 would be extended into the tab-receiving recess 32' of the adjacent wall panel 12'. Once the connecting tab 30 is housed entirely within the tab-receiving recess 32', the front and back paper plates 16' and 18' of the adjacent wall panel 12' would be secured to the connecting tab 30, thus securing the connecting tab 30 within the tab-receiving recess 32' and connecting the wall panel 12 to the adjacent wall panel 12'. It is expected that an adhesive material such as a non-toxic glue would be used to secure the front and back paper plates 16' and 18' to the connecting tab 30, although the precise nature of the securement of the front and back paper plates 16' and 18' to the connecting tab 30 is not critical to the present invention so long as the connection is secure and cannot be easily undone by a child being retained within the divider device 10. In a similar manner as described above, each of the adjacent wall panels 12 would be connected to one another thus forming the foldable foam-based divider device 10 of the present invention.

The divider device 10 of the present invention would be used in the following manner. The divider device 10 would be stored in the closed position shown in FIG. 2 wherein each of the wall panels 12 are placed in generally parallel position with the wall panels 12 folded in accordion-like fashion. Given the very light yet rigid nature of the wall panels 12, it is expected that the entire weight of the divider device 10 will be quite small, thus permitting its use by virtually anyone regardless of size, strength or coordination. The user of the foldable foam-based divider device 10 of the present invention would then begin to unfold the wall panels 12 into the open position as shown best in FIGS. 1 and 3 where the wall panels 12 may be positioned to form an extended wall operative to selectively divide an area. As shown best in FIG. 1, the wall panels 12 would be positioned to surround a child 50 thus keeping the child 50 within the selected area and making the task of observing the child much easier. In addition, if the child 50 is old enough, he or she may be given a marking device 52 such as a washable marker or the like, which may be used to draw on the wall panels 12, specifically on the front and back paper plates 16 and 18 on each of the wall panels 12 which are positioned on the inside face of the divider device 10. This ability to personalize the wall panels 12 of the foldable foam-based divider device 10 of the present invention is not found in the majority of divider devices in the prior art and represents a significant improvement over those devices. Of course, it is also entirely possible and may even be preferable to print various designs and indicia on the front and back paper plates 16 and 18 on each of the wall panels 12 instead of providing the writing surface for the child, as small children would likely prefer a colorful or enjoyable design printed on each wall panel 12.

It may also be advantageous to include a divider device closure device 40 which allows the end wall panels to be releasably connected to one another to complete the enclosure provided by the divider device 10. The divider device closure device 40 may be of any appropriate kind, such as a hook and loop fastener, releasable snaps or virtually any other type of closure device as will be determined by the manufacturer of the present invention and by the overall size of the divider device 10.

Figure 2:
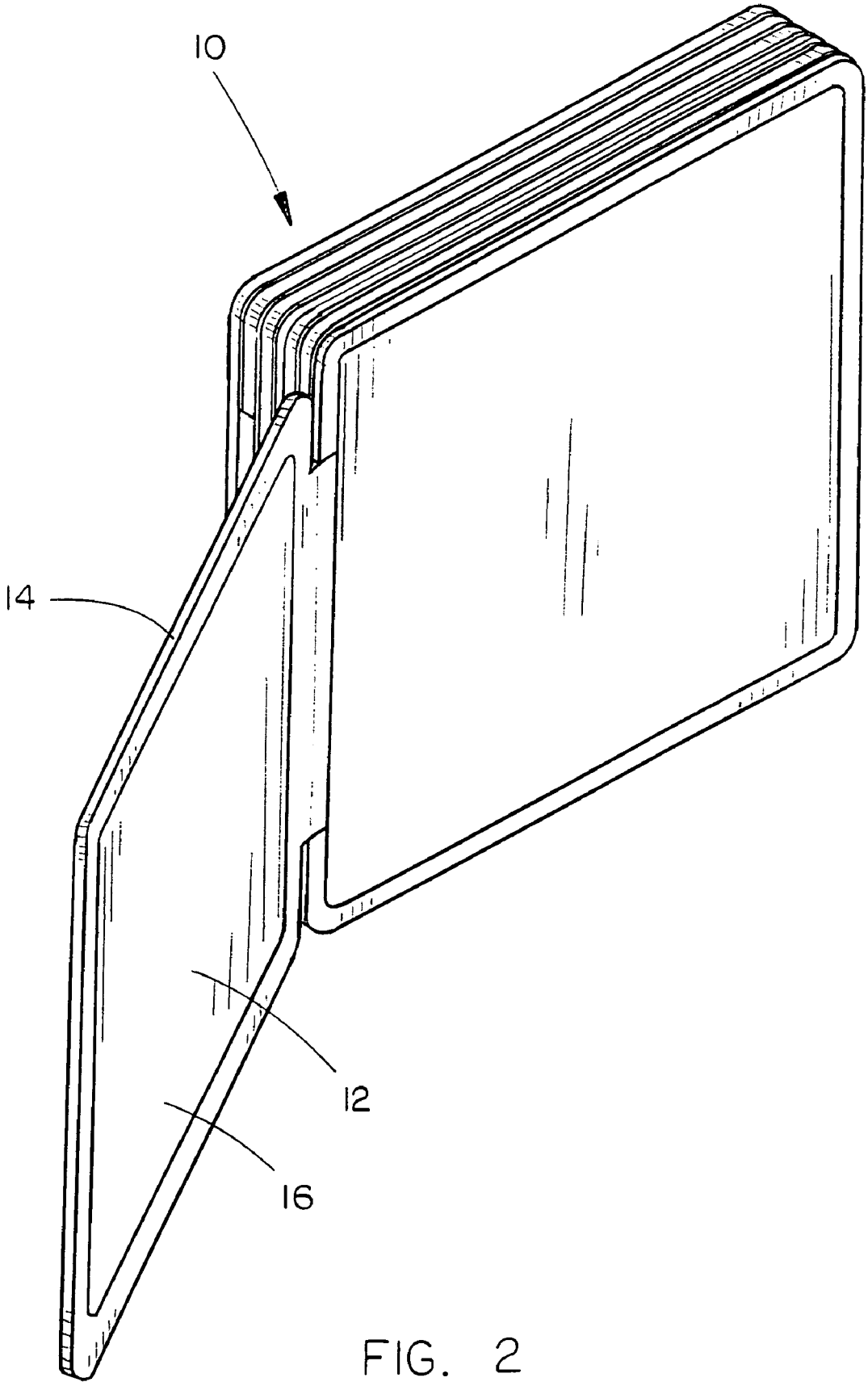
FIG. 2 is a perspective view of the divider device of the present invention as it is initially being moved from its closed position.
Figure 3:
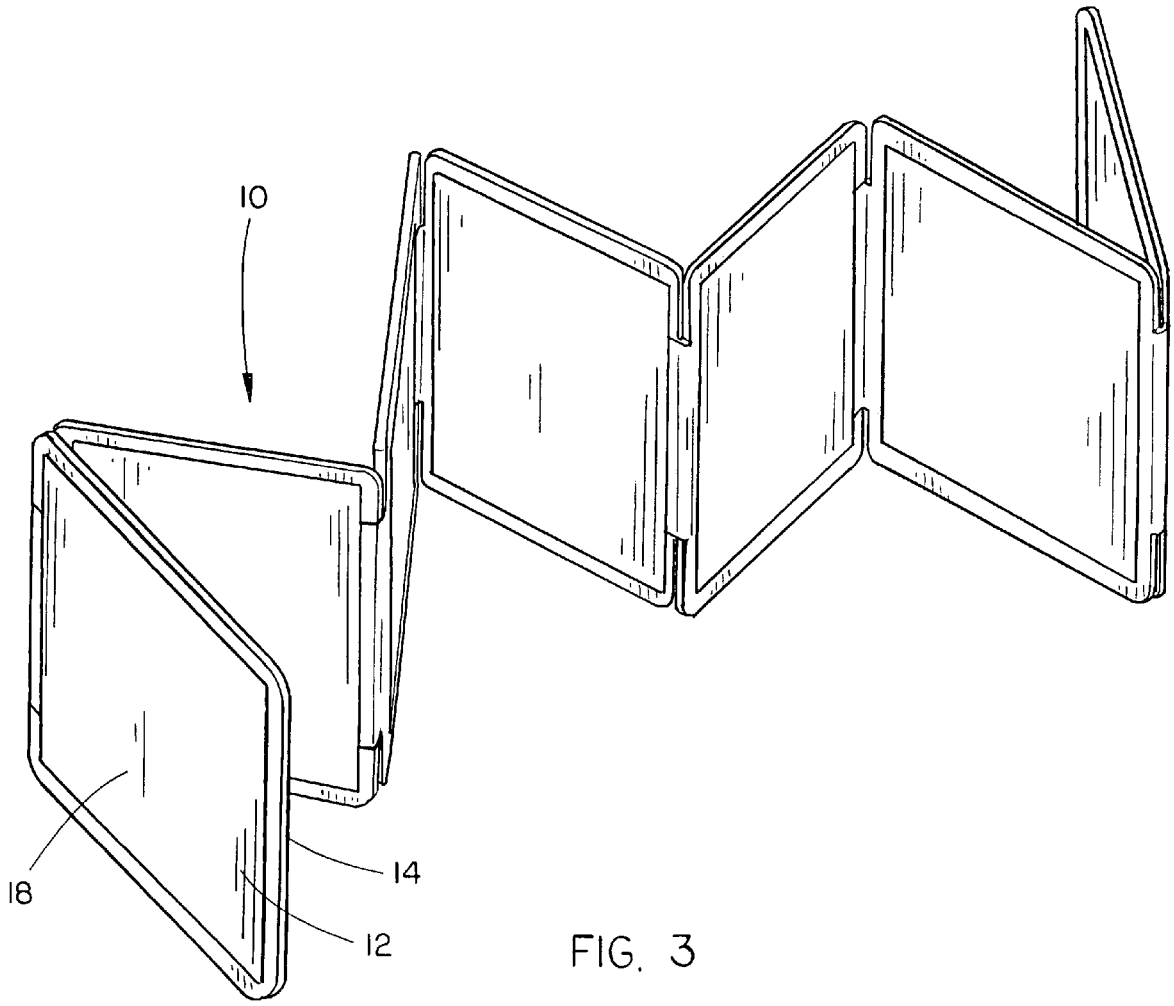
FIG. 3 is a perspective view of the divider device of the present invention in its opened position where the plurality of panels form an extended wall.

Once the user of the present invention decides that it is time to remove the divider device 10, it is a simple matter to reverse the above-described procedure and fold the wall panels 12 from the open position back into the closed position of FIG. 2 and put the folded divider device 10 back into a chosen storage area. It is precisely the rapid and simple manner in which the divider device 10 of the present invention may be taken from the closed storage position to the opened use position that renders the present invention so effective, and it should be further noted that the configuration of the opened position is only limited by the number of wall panels 12 used in connection with the foldable foam-based divider device 10 of the present invention and virtually any cordoned-off area may be defined by use of the divider device 10 of the present invention, a feature not found in many divider devices of the prior art.

It is to be understood that numerous additions, modification and substitutions may be made to the foldable foam-based divider device 10 of the present invention which fall within the intended broad scope of the appended claims. For example, the size, shape and specific construction materials used may be modified or changed so long as the intended paper/foam/paper configuration of the wall panels 12 of the divider device 10 is maintained. Furthermore, the size, shape and number of connecting tabs 30 and, correspondingly, the number of tab-receiving recesses 32 may be modified or changed should the size and shape of the wall panels 12 necessitate such modifications, so long as the intended function of securing adjacent panels to one another is maintained. Also, the use of the divider device 10 of the present invention should not be limited to only use as a divider, but is usable in other ways also. For example, by hanging the divider device 10 on a wall, it may be used as a growth chart where the height of the child may be charted over time. Finally, it should be noted that the colors and designs used in connection with the wall panels 12 of the present invention may be modified or changed to enhance the appearance of the divider device 10 and therefore increase the attractiveness of the present invention for the users and for the children retained within the present invention.

There has therefore been shown and described a foldable foam-based divider device 10 which accomplishes at least all of its intended objectives.

I claim:

1. A foldable foam-based divider device comprising:

a plurality of panels, each panel including a middle foam plate and front and back semi-rigid paper plates mounted on and sandwiching said middle foam plate, said middle foam plate further including at least one outwardly extending connecting tab on one side of said middle foam plate and at least one tab-receiving recess formed on an opposite side of said middle foam plate;

said middle foam plate being larger than said front and back semi-rigid paper plates such that said middle foam plate extends beyond the edges of said front and back paper plates whereby the edges of each of said panels are foam;

adjacent ones of said plurality of panels connected to one another in accordioned fashion with said at least one connecting tab extending into said at least one tab-receiving recess and being secured therein by connection of said front and back semi-rigid paper plates to said at least one connecting tab thereby securing adjacent ones of said plurality of panels; and said plurality of panels movable between a closed position with said plurality of panels forming a folded stack of generally parallel panels and an opened position where said plurality of panels forms a wall operative to selectively divide an area.

2. The foldable foam-based divider device of claim 1 wherein said front and back semi-rigid paper plates are secured to said at least one connecting tab via an adhesive glue material.

3. The foldable foam-based divider device of claim 1 further comprising two end wall panels at opposite ends of said foldable foam-based divider device and a divider device closure device mounted on at least one of said two end wall panels operative to releasably connect said two end wall panels to one another to complete the enclosure provided by the divider device.

4. The foldable foam-based divider device of claim 1 wherein said front and back semi-rigid paper plates are operative to take markings produced by a writing implement and retain said markings thereon.

5. A foldable foam-based panel set comprising:

a plurality of panels, each panel including a middle foam plate and front and back semi-rigid paper plates mounted on and sandwiching said middle foam plate, said middle foam plate further including at least one outwardly extending connecting tab on one side of said middle foam plate and at least one tab-receiving recess formed on an opposite side of said middle foam plate;

said middle foam plate being larger than said front and back semi-rigid paper plates such that said middle foam plate extends beyond the edges of said front and back paper plates whereby the edges of each of said panels are foam;

adjacent ones of said plurality of panels connected to one another in accordioned fashion with said at least one connecting tab extending into said at least one tab-receiving recess and being secured therein by connection of said front and back semi-rigid paper plates to said at least one connecting tab thereby securing adjacent ones of said plurality of panels; and said plurality of panels movable between a closed position with said plurality of panels forming a folded stack of generally parallel panels and an opened position wherein said plurality of panels are extended generally outwards.

* * * * *